US006658781B1

(12) United States Patent
Bowen

(10) Patent No.: US 6,658,781 B1
(45) Date of Patent: Dec. 9, 2003

(54) GRIP FOR FIREARMS

(75) Inventor: Gary Bowen, Cedar Rapids, IA (US)

(73) Assignee: Steadyhold Products, LLC, Cedar Rapids, IA (US)

( * ) Notice: Subject to any disclaimer, the term of this patent is extended or adjusted under 35 U.S.C. 154(b) by 0 days.

(21) Appl. No.: 10/324,994

(22) Filed: Dec. 19, 2002

Related U.S. Application Data

(63) Continuation of application No. 09/682,175, filed on Jul. 31, 2001, now abandoned.

(51) Int. Cl.[7] ..... F41A 17/00
(52) U.S. Cl. ..... 42/71.02; 42/72; 89/1.42
(58) Field of Search ..... 42/71.02, 72, 74, 42/94; 89/1.42

(56) References Cited

U.S. PATENT DOCUMENTS

| | | | | | |
|---|---|---|---|---|---|
| 63,303 | A | * | 3/1867 | Restell | 42/69.01 |
| 445,192 | A | * | 1/1891 | Denham et al. | 42/71.01 |
| 1,357,208 | A | * | 10/1920 | Payne | 42/75.01 |
| 1,585,249 | A | * | 5/1926 | Johns | 42/71.01 |
| 2,386,802 | A | * | 10/1945 | Johnson | 42/94 |
| 2,498,749 | A | * | 2/1950 | Benson | 42/71.01 |
| 2,782,545 | A | * | 2/1957 | Schadeck | 42/71.01 |
| 2,826,848 | A | * | 3/1958 | Davies | 42/71.01 |
| 3,164,920 | A | * | 1/1965 | Haas | 42/71.01 |
| 3,623,257 | A | * | 11/1971 | Ray | 42/71.01 |
| 3,861,070 | A | * | 1/1975 | Wild et al. | 42/85 |
| 4,148,149 | A | * | 4/1979 | Pachmayr et al. | 42/71.02 |
| 4,321,765 | A | * | 3/1982 | Gillum | 42/72 |
| 4,502,238 | A | * | 3/1985 | Farrar et al. | 42/72 |
| 5,048,215 | A | * | 9/1991 | Davis | 42/72 |
| 5,068,992 | A | * | 12/1991 | Velezis et al. | 42/72 |
| 5,180,874 | A | * | 1/1993 | Troncoso, Jr. | 42/72 |
| 5,345,706 | A | * | 9/1994 | Brown | 42/94 |
| D351,448 | S | * | 10/1994 | Fisher | D22/108 |
| 5,417,002 | A | * | 5/1995 | Guerra | 42/72 |
| 5,852,892 | A | * | 12/1998 | Bilgeri et al. | 42/94 |
| 5,946,842 | A | * | 9/1999 | Nyzell et al. | 42/72 |
| 5,956,879 | A | * | 9/1999 | Zerega | 42/72 |
| 6,019,024 | A | * | 2/2000 | Robinson et al. | 89/1.42 |
| 6,055,760 | A | * | 5/2000 | Cuson et al. | 42/74 |
| 6,487,807 | B1 | * | 12/2002 | Kopman et al. | 42/94 |

* cited by examiner

*Primary Examiner*—Michael J. Carone
*Assistant Examiner*—M. Thomson
(74) *Attorney, Agent, or Firm*—James C. Nemmers

(57) ABSTRACT

A grip that can be easily attached to and removed from a handgun or a rifle. In the case of a handgun, the grip is easily slipped onto the gun frame ahead of the trigger guard, and it extends downwardly with the exterior surface containing soft and comfortable finger grips for the other hand of the user. In the case of a rifle, the grip is provided at its upper end with a quick detachable mechanism that can be quickly attached and removed from the conventional mounting base on the under side of the stock of the rifle. The grip is provided with a soft material on its exterior surface with finger grips so that the rifle can be comfortably gripped by the user and allow the rifle to be held steadily when aiming and shooting.

8 Claims, 7 Drawing Sheets

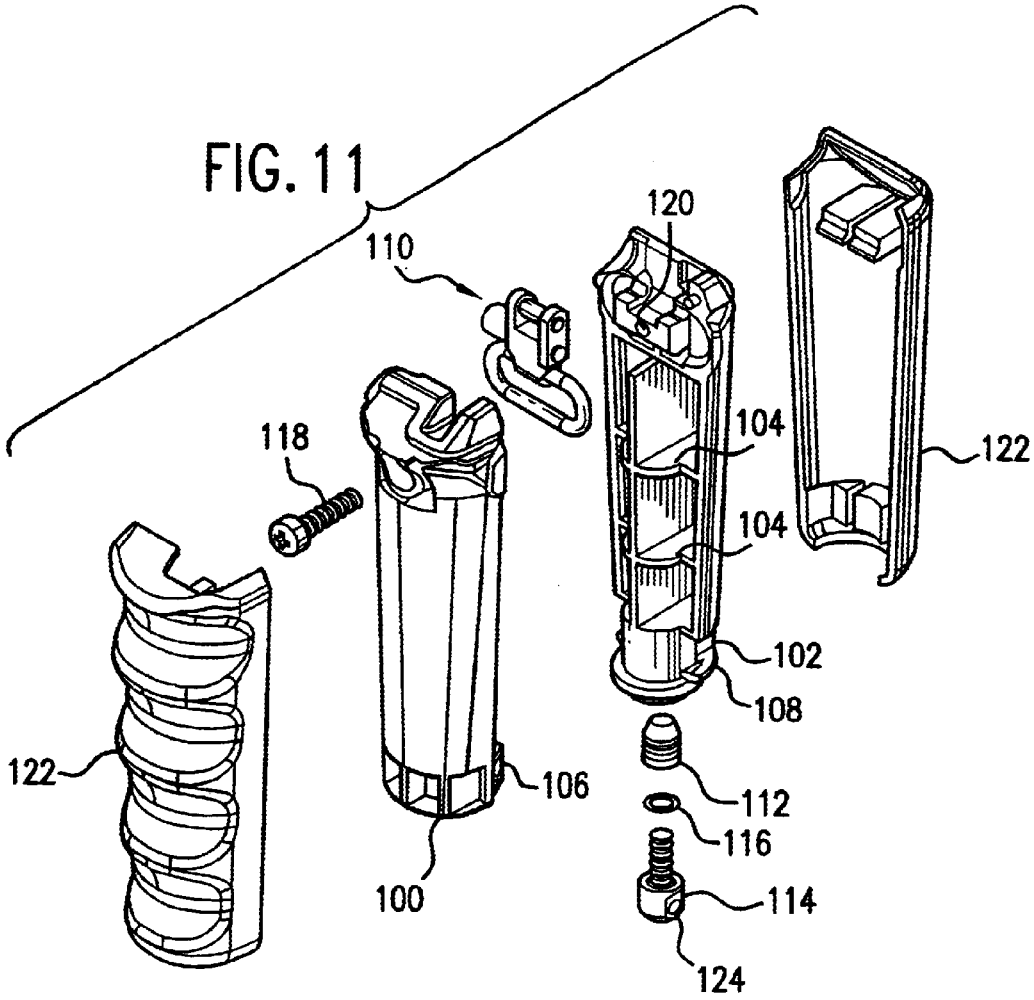
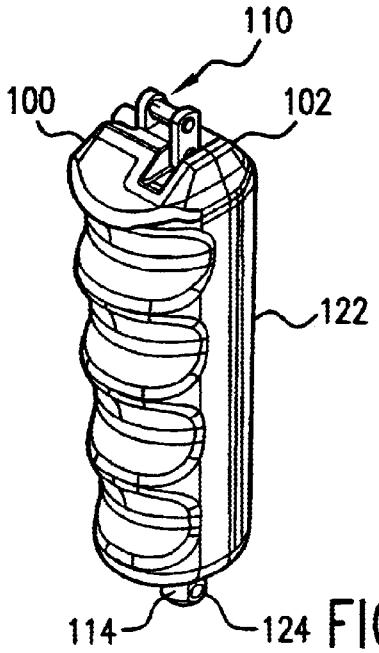
FIG. 13
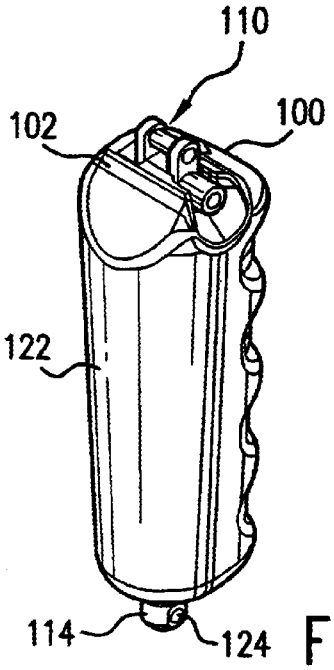
FIG. 12

GRIP FOR FIREARMS

BACKGROUND OF THE INVENTION

Firearms such as pistols, revolvers and rifles are commonly used not only for hunting but also for competitive target shooting. Especially in the latter case, accuracy is extremely important and it is vital that the user hold the firearm as steady as possible in order to achieve maximum accuracy.

Typically, shooters of handguns will use one hand to grip the firearm, as there is no additional grip on the handgun to allow the other hand to hold and steady it. Of course, in the case of rifles, the user will place the butt of the firearm against a shoulder and grip the firearm so that the trigger finger can be placed against the trigger while the weapon is steadied with the other hand by placing it on the stock beneath the barrel in an unnatural twisted and skewed holding position. This typical hold position creates excessive muscle and tendon tension resulting in involuntary movement of the hold hand, arm and wrist. This excessive movement results in shot placement inaccuracies.

It is desirable that the weapon be held as comfortably and as steadily as possible in order to achieve maximum accuracy. There is therefore a need for an improved manner of gripping and holding handguns and rifles to improve the accuracy of aiming the firearm and to provide for holding it steady when it is fired. Handgun accuracy can be improved by using a two-hand separated hold. Accuracy can also be improved by keeping the hold hand, arm and wrist of a handgun or rifle shooter in a natural and comfortable untwisted, non-skewed position. Any device that is used in connection with a handgun or rifle should not only be comfortable, but it should be easy to attach and remove when the firearm is not in use.

It is therefore a primary object of the invention to provide an additional grip so that the user can hold and maintain a handgun or rifle as steady as possible to improve and maintain accuracy in aiming and shooting.

SUMMARY OF THE INVENTION

The invention provides a grip that can be easily attached to and removed from a handgun or a rifle. In the case of a handgun, the grip is easily slipped onto the gun frame ahead of the trigger guard, and it extends downwardly with the exterior surface containing soft and comfortable finger grips for the non-firing hand of the user. In the case of a rifle, the grip is provided at its upper end with a quick detachable mechanism that can be quickly attached and removed from the conventional mounting base on the under side of the forearm area of a conventional rifle stock. The mounting base of a conventional rifle is provided for attachment of a sling, and the grip of the invention provides at its lower end an area for re-attachment of the sling. In this manner, the grip can be attached to the underside of the stock of the rifle and the sling attached to the bottom of the grip. The grip is provided with a soft material on its exterior surface with finger grips so that the rifle can be comfortably gripped by the user and the rifle held steady during aiming and shooting.

BRIEF DESCRIPTION OF THE DRAWINGS

FIG. 11 is an exploded perspective view of yet another embodiment of the grip assembly of the invention;

FIG. 12 is a perspective view of the grip assembly of the embodiment of FIG. 11 showing the assembly from the front containing the finger recesses; and FIG. 13 is a perspective view of the grip assembly of the embodiment of FIG. 11 showing the assembly from the rear.

DETAILED DESCRIPTION

Figure 1:
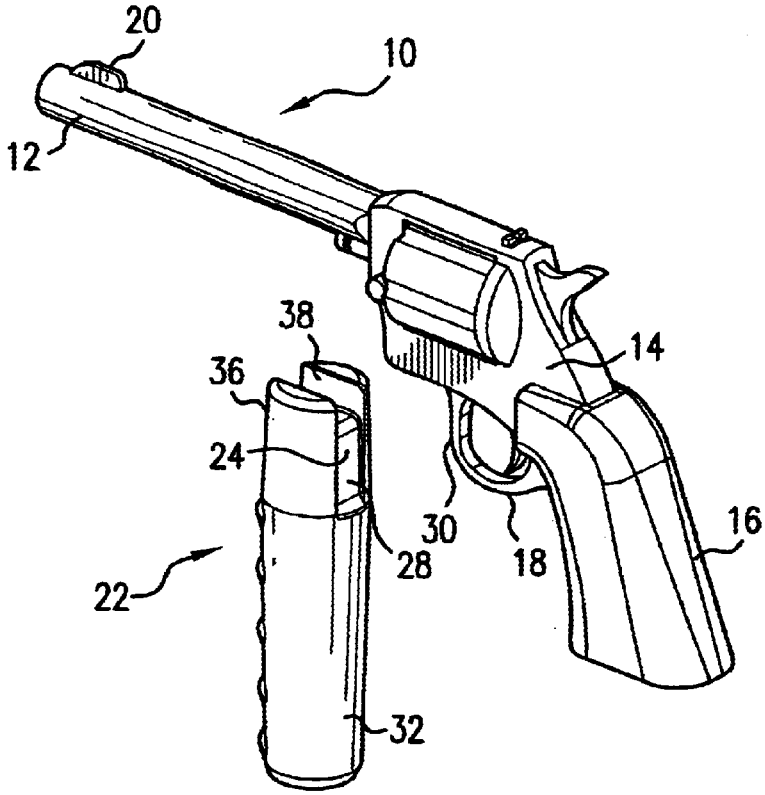
FIG. 1 is a perspective view showing the grip of the invention detached from a handgun such as a revolver.

Referring first to FIGS. 1–5, there are shown views of the embodiment of the invention for use in connection with a handgun such as a revolver 10. The revolver 10 that is shown is a conventional revolver which has a barrel 12 extending outwardly and forwardly from the main frame 14 to which is attached a downwardly extending handle or grip 16. Extending downwardly from the main frame 14 is a trigger guard 18. As is well known, the user of the revolver will grip the weapon by holding the handle 16 so that the trigger finger can extend inside of the trigger guard 18 ready to fire the weapon when it is aimed. To aim the weapon, the user will extend his or her arm forwardly so that the weapon can be aimed using the sight 20 at the forward end of the barrel 12. It is obvious to anyone that has used a handgun that to steady the handgun in such a position for aiming and firing is somewhat difficult. Especially, when the weapon is used in competitive target shooting, accuracy is extremely important and it becomes vital that the user hold the weapon as steady as possible so that it can properly aimed at the target and fired when ready.

Figure 2:
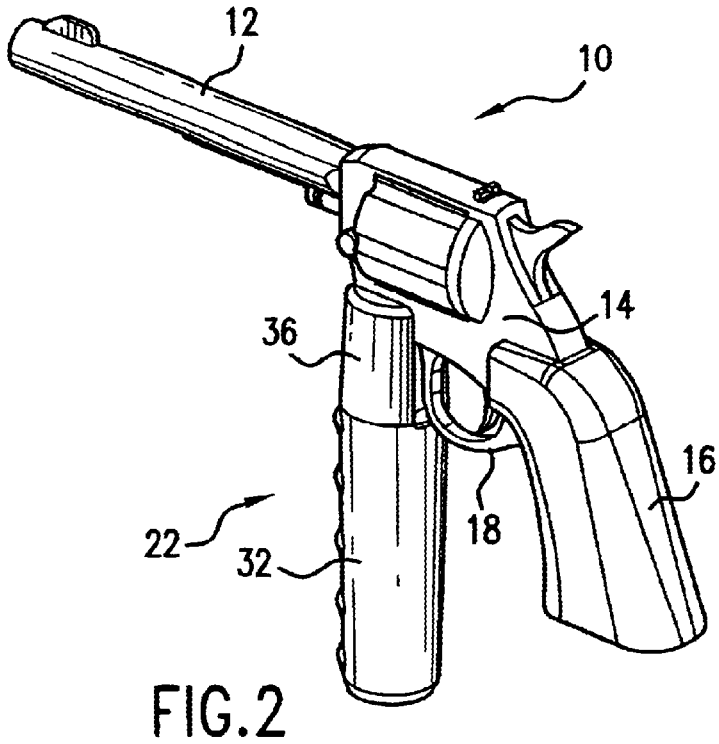
FIG. 2 is a perspective view similar to FIG. 1 but showing the grip of the invention attached to the revolver.
Figure 3:
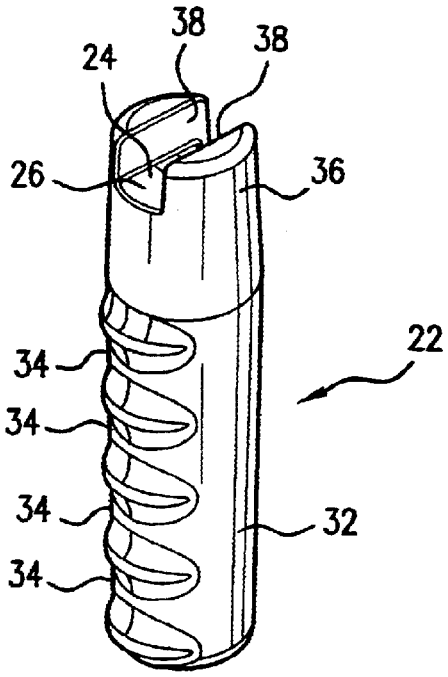
FIG. 3 is a perspective view of the grip of the invention.
Figure 4:
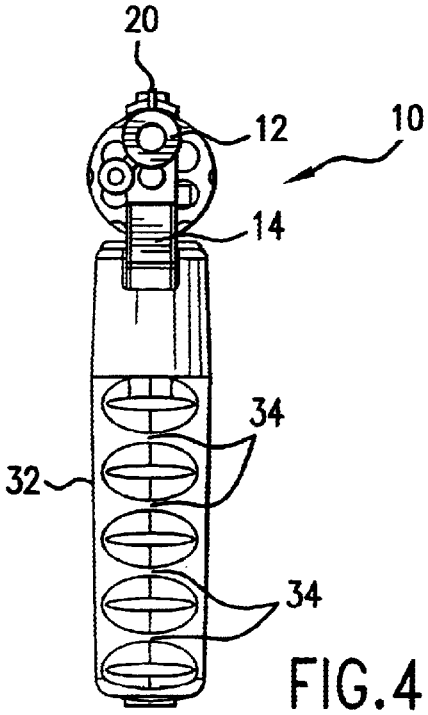
FIG. 4 is a front elevational view of the grip of the invention viewing it when it is attached to the handgun.
Figure 5:
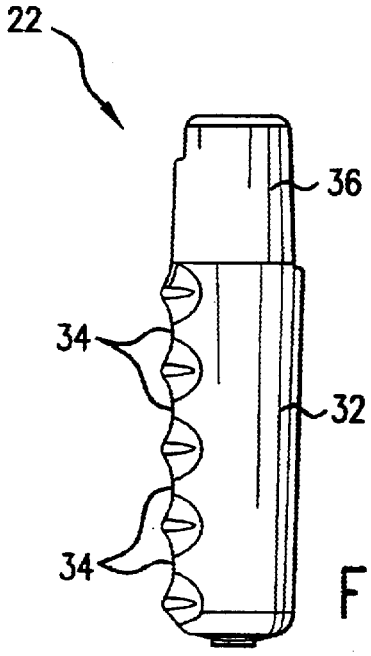
FIG. 5 is a side elevational view of the grip of the invention.
Figure 6:
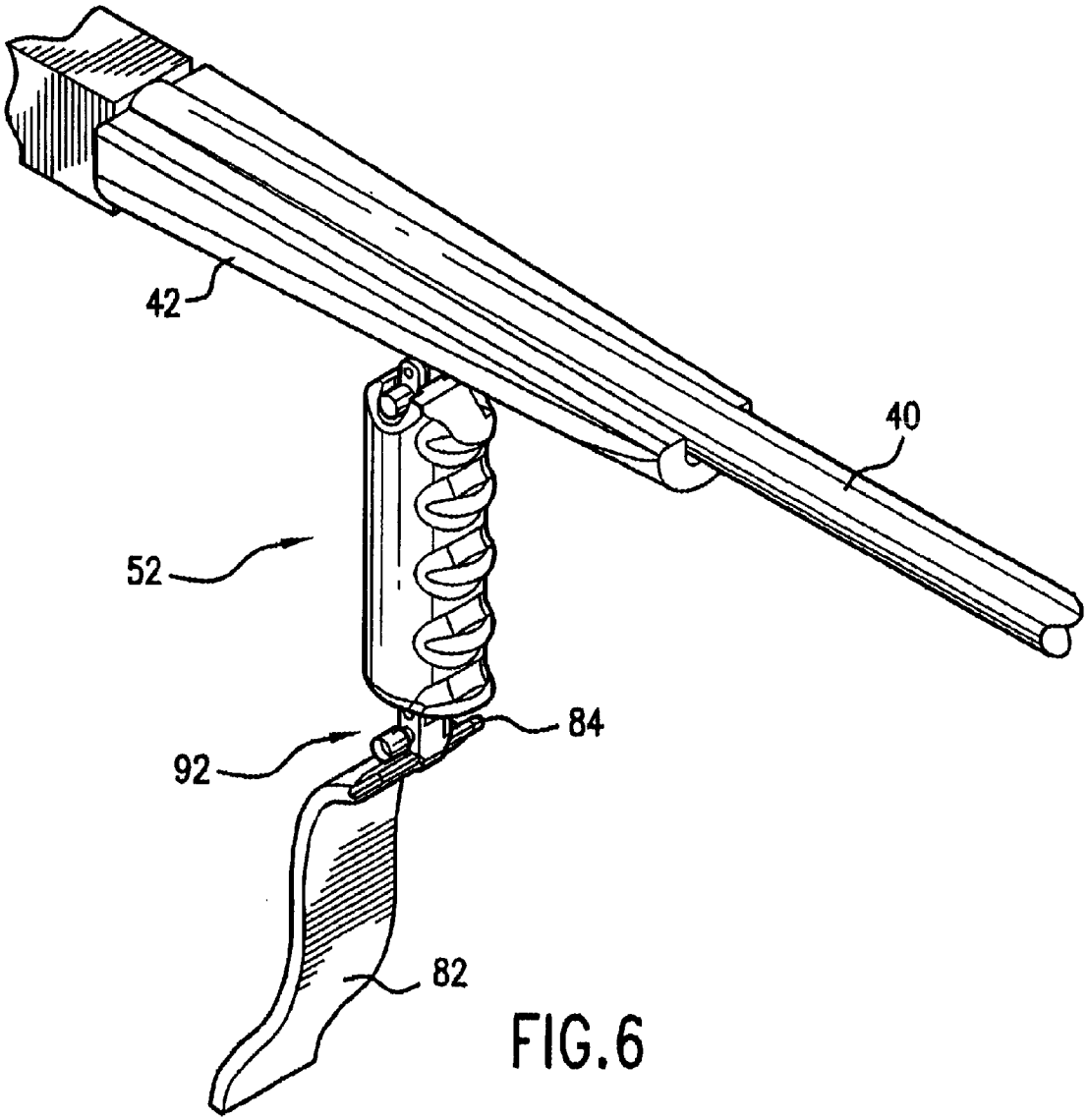
FIG. 6 is a perspective view of another embodiment of the invention for attachment to a rifle and showing the grip assembly of the invention assembled to the rifle.

The invention provides an additional grip, indicated generally by the reference numeral 22, that can be quickly attached and detached from the revolver 10. As shown in the drawings, the grip 22 has a central core 24 formed of a solid rigid material such as metal or hard plastic. The core has an upper surface 26 that is substantially flat and of a width approximately the same as the bottom edge of the main frame 14 of the revolver 10. The core 24 also has a rear surface 28 shaped to fit closely to the forward edge 30 of the trigger guard 18. The lower portion 32 of the grip assembly 22 surrounds the core 24 and is formed of a relatively soft material containing finger recesses 34 in the forward side to provide a comfortable grip for the user's hand. Although the drawings show the grip assembly 22 to be somewhat cylindrical in shape, any other shape that would be comfortable for the user's hand could also be used. The upper portion 36 of the grip assembly 22 is bifurcated and extends upwardly beyond the upper surface 26 of the core 24. The interior surfaces 38 of the upper portion 36 are substantially flat and spaced apart to provide a tight fit over the lower portion of the main frame 14 when the grip assembly 22 is in place as shown in FIG. 2. The upper portion 36 also is preferably made of a material such as rubber or pliable plastic so as to provide a snug fit around the main frame 14 of the revolver 10 when the grip assembly 22 is in place. When properly positioned on the revolver 10, as shown in FIG. 2, the interior surfaces 38 extend alongside of the main frame 14 and because of the tight fit will grip the side surfaces of the main frame 14. The bottom edge of the main frame 14 will rest on the upper surface 26 of the core 24 while the rear surface 28 of core 24 will engage the forward surface of the trigger guard 18. When thus properly positioned, the grip assembly 22 of the invention will allow the user to place the other hand (the hand other than the one gripping the handle 16 of the revolver 10) so that the aiming and firing of the revolver 10 can be maintained in a steady, constant position more easily than when the revolver 10 is gripped using only a single hand.

Figure 7:
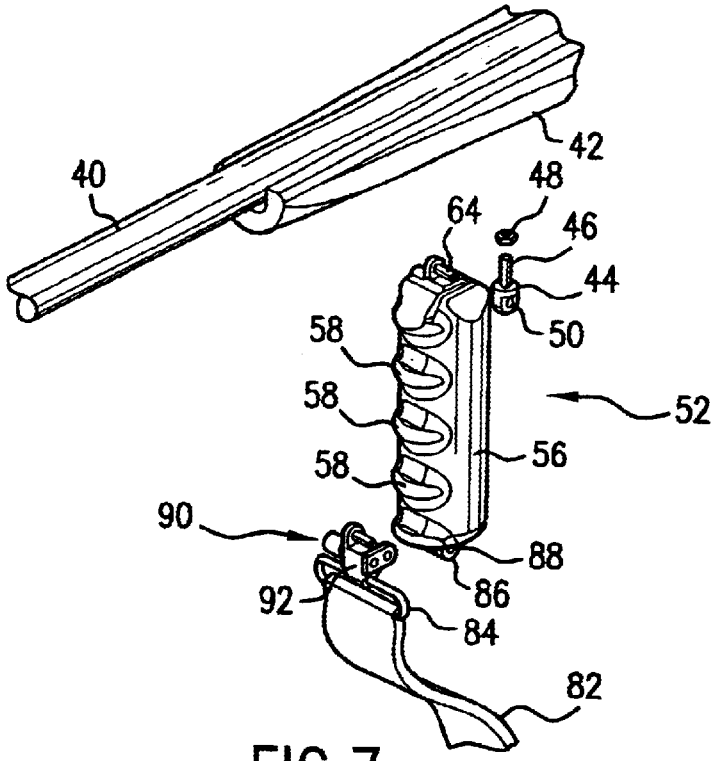
FIG. 7 is a perspective view of the grip assembly of the invention, the figure showing an exploded view of the grip and sling mechanism.
Figure 8:
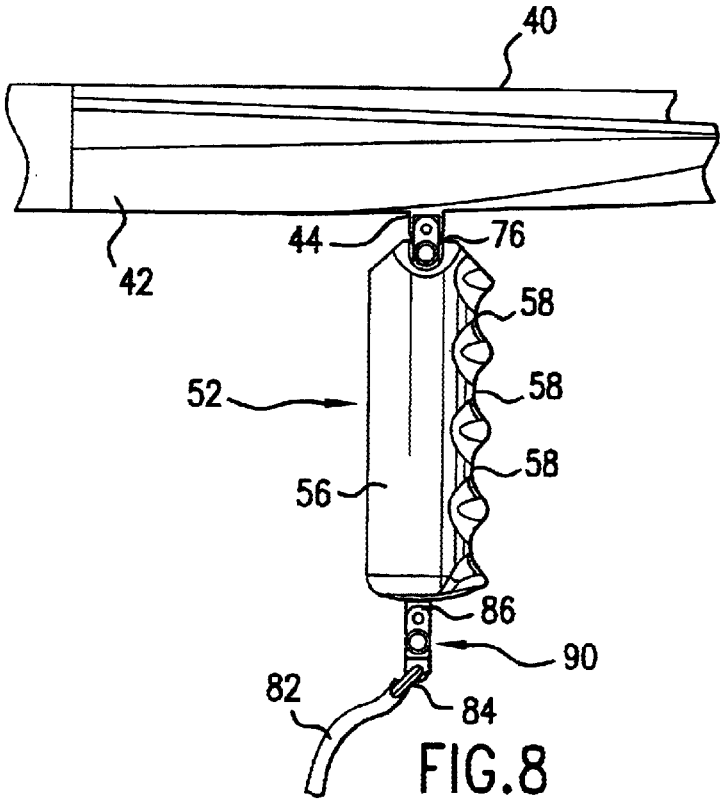
FIG. 8 is a side elevational view of the grip of the invention showing it attached to the underside of the stock of the rifle with the sling attached to the bottom of the grip.

Referring now to FIGS. 6–10 of the drawings, there is shown a second embodiment of the invention in which a grip assembly constructed according to the invention is adapted for use in connection with a firearm such as a rifle. Only a portion of a conventional rifle is shown which has a barrel 40 beneath which is a wooden or plastic stock 42. As best seen in FIG. 7, a mounting base 44 is attached to the underside of the stock 42 in any suitable manner such as by inserting the threaded attachment pin 46 into the stock 42 and securing it and locking it into place on the top side using the nut 48. When in place, the mounting base 44 will extend downwardly from the underneath of the stock 42. The mounting base 44 has an opening 50 extending laterally through it as best seen in FIG. 7.

Figure 9:
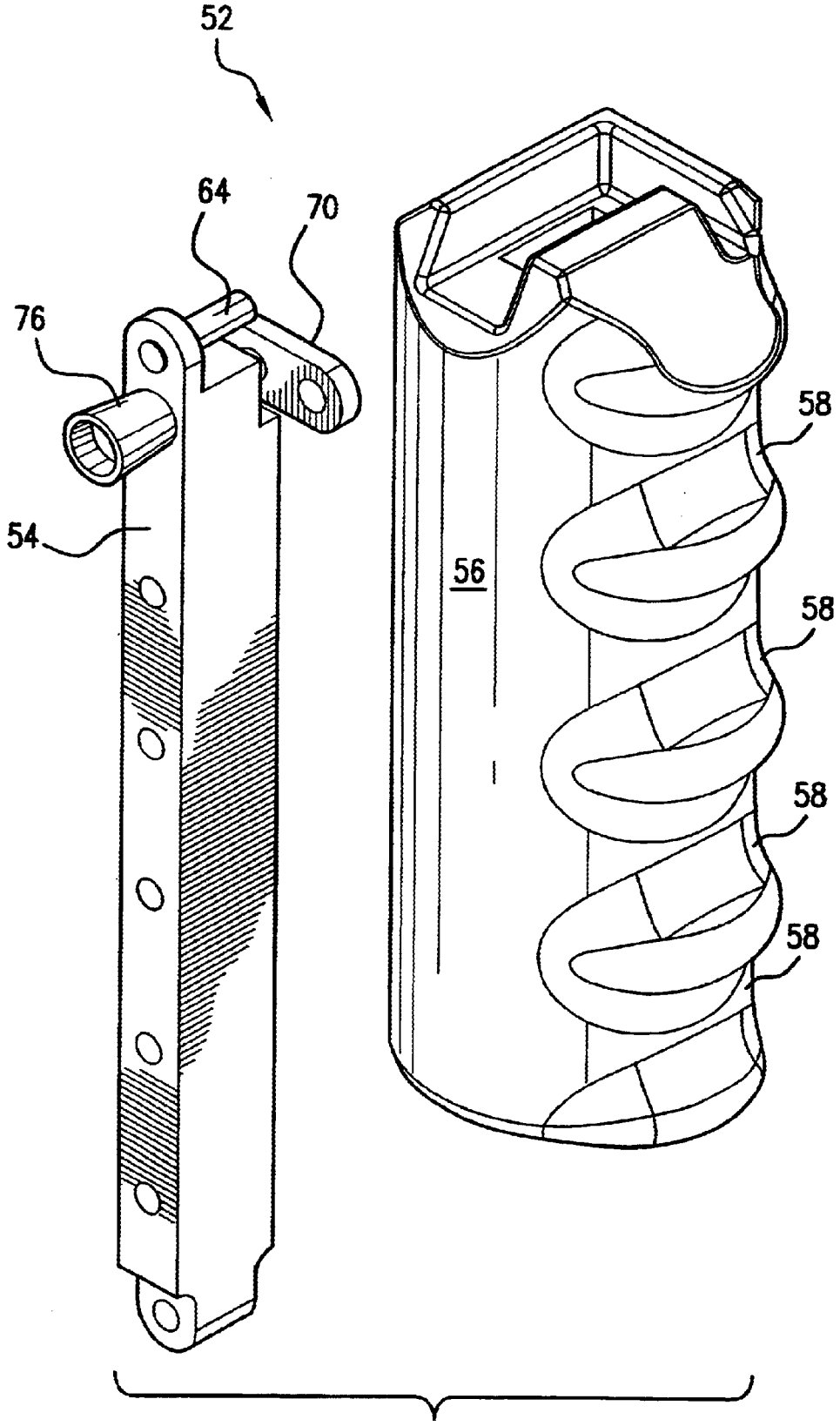
FIG. 9 is a view showing the grip assembly with the core portion separated and showing these components in a perspective view.
Figure 10:
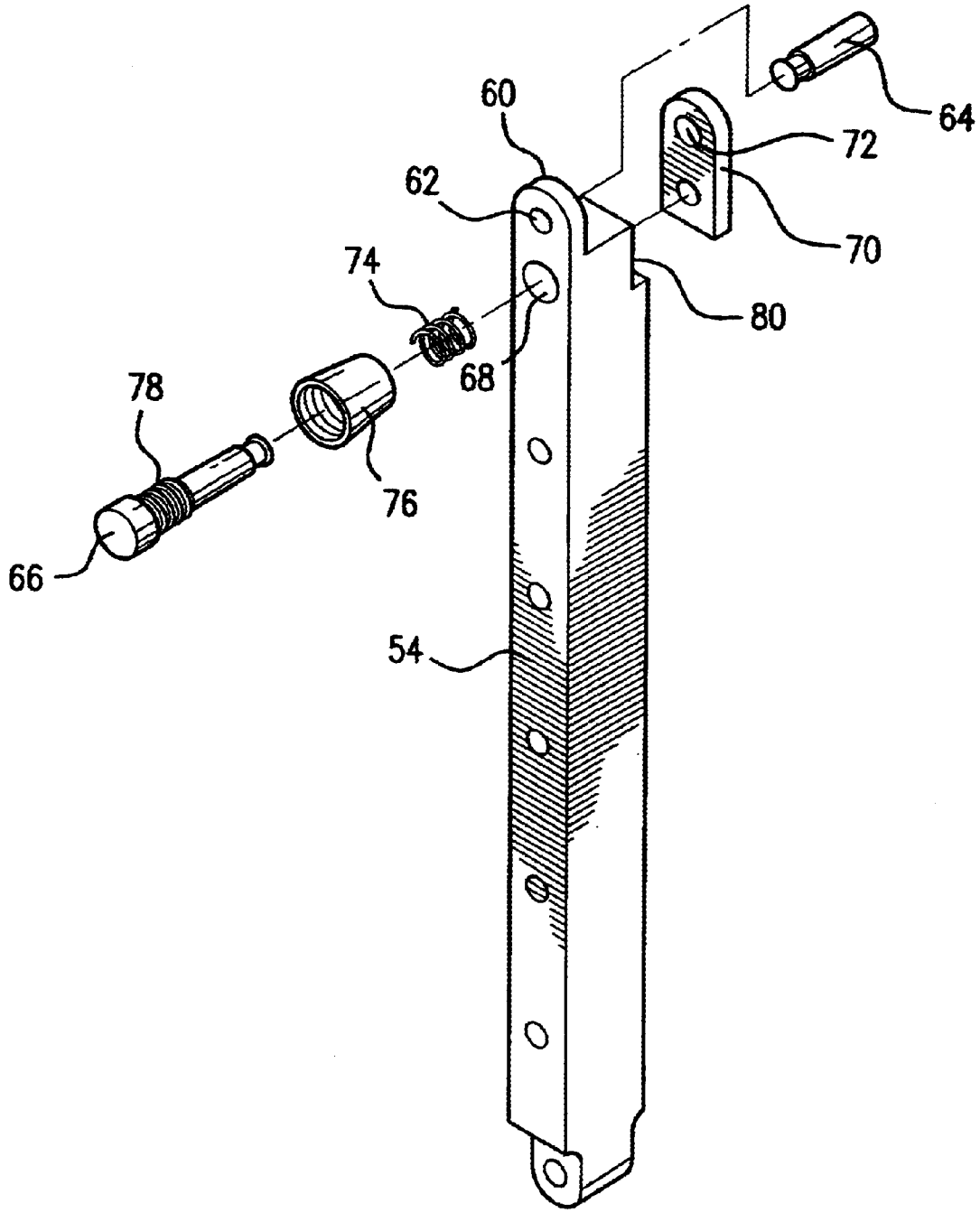
FIG. 10 is an exploded view of the core portion of the grip assembly and showing the component of the locking mechanism.

As best shown in FIGS. 7, 8, 9 and 10, the grip assembly 52 of the invention has a core 54 of a solid rigid material similar to that of the first embodiment described above. The core 54 is covered with a covering 56 of soft pliable material such as rubber or polyurethane plastic that has finger recesses 58 formed in the forward surface of the grip assembly 52. The grip assembly 52 thus provides a comfortable grip for the hand of the user. As best seen in FIG. 10, the core 54 has formed with it an upwardly extending portion 60 having an opening 62 formed in it which opening 62 is adapted to receive a pin 64 affixed to it. A second pin 66 extends through a lateral opening 68 just beneath the opening 62 in the upper portion 60 of core 54. The outer end of pin 66 is affixed to a retainer 70 which has an opening 72 formed in it. The diameter of opening 72 is slightly larger than the outside diameter of the pin 64. Pin 66 has a coil spring 74 positioned around it and a lock sleeve 76 positioned around the outer end of the pin 66. Spring 74 is positioned inside of opening 68 and engages a shoulder 78 formed by the enlarged head of the pin 66. Lock sleeve 76 with internal threads is turned onto the exterior threaded shoulder 78 of pin 66. The spring 74 therefore biases the pin 66 toward the lock sleeve 76, and since the outer end of the pin 66 is attached to the retainer 70, the retainer will normally be positioned against the side 80 of the core 54. However, when the pin 66 is pushed inwardly, it will force the retainer 70 outwardly away from the core 54 and allow the locking sleeve 76 to be gripped and turned, thus turning the retainer 70 upwardly so that it can engage the pin 64 which will then be seated in the opening 72. As best seen in FIG. 9, the retainer 70 when in the unlocked position will extend forwardly and be disengaged from the pin 64. This quick detachable assembly that has just been described permits the grip assembly 52 to be quickly and easily attached to and detached from the mounting base 44. In other words, with the retainer 70 in its unlocked position as shown in FIG. 9, the pin 64 is slipped through the opening 50 in the mounting base 44 after which the lock sleeve 76 is depressed and turned so that the retainer 70 can be swung upwardly until it engages the pin 64, and when the lock sleeve 76 is released, the spring 74 will move the retainer 70 onto the pin 64 and maintain it in a locked position.

Since the conventional rifle has a sling 82 with a ring 84 typically attached to the mounting base 44, when it is desired to use the grip assembly 52 of the invention, the sling 82 and ring 84 will have to be detached from the mounting base 44. To facilitate this, a similar locking mechanism to that just described is used. As best seen in FIG. 7, the bottom of the grip assembly 52 has a mounting 86 having an opening 88 extending through it which mounting 86 is similar to the mounting base 44. The mounting 86 is formed as or permanently attached to the bottom of the grip assembly 52. A locking assembly 90 substantially identical to that just described is then removably attached to the mounting 86 with the ring 84 of sling 82 affixed to the locking mechanism 90 by extending the ring 84 through the opening formed in the main base 92 of the locking mechanism 90.

Referring now to FIGS. 11, 12 and 13, there is shown another embodiment of the invention in which a rigid core is molded in two parts and then the soft flexible grip portion is over-molded. In this embodiment, the core has a front pre-molded portion 100 and a pre-molded rear portion 102. The drawings show the particular configuration of the core portions 100 and 102 which, as shown, are designed to be easily molded by an injection molding process. Each of the portions 100 and 102 are hollow and thus contain strengthening ribs 104, although the ribs for the portion 100 are not shown in FIG. 11 because of the orientation of the view. Portion 100 contains at its lower end locking tabs 106 that engage corresponding male locking tabs 108 at the lower portion of the core portion 102. The portions 100 and 102 are molded to receive and hold in place a quick detach mechanism similar to that described with reference to the second embodiment of the invention. However, the quick detach mechanism 110 shown in FIGS. 11–13 is the mechanism shown and described in U.S. Pat. No. 5,067,267. The formation of the molded core portions 100 and 102 contain recesses to receive the quick detach mechanism 110 when the core portions 100 and 102 are assembled and locked together using the locking tabs 106 and 108. The quick detach mechanism 110 operates in the same manner as the second embodiment and as fully and completely described in U.S. Pat. No. 5,067,267.

Also received in the bottom of the core portion 102 is an insert 112 that is preformed and inserted into a corresponding opening in the bottom of core portion 102 and retained tightly by an interference bit. A stud post 114 and O-ring 116 are threaded into the insert 112 during the assembly process.

Once the insert 112 is pressed into place in the core portion 102 and the core portion 102 is joined to the core portion 100 with the quick detach mechanism 110 engaged between portions 100 and 102, the core portions 100 and 102 are further held in assembled condition by use of fastener 118 which is threaded through the core portion 100 and into a threaded recess 120 in the core portion 102. When thus assembled, the quick detach mechanism 110 is firmly held in place by the core portions 100 and 102.

The core formed by the core portions 100 and 102 is then covered by the soft covering 122 which is molded over the assembled core assembly. FIG. 10 shows the covering 122 split into two portions for purposes of clarity. FIGS. 12 and 13 are views of the finally assembled and completed grip assembly. When thus assembled, the stud post 114 provides for mounting of the sling of the rifle by use of the opening 124 in the stud post, similar to that described with reference to the second embodiment.

From the foregoing description of the preferred embodiments of the invention, it will be evident to those skilled in the art that there has been provided a simple, easily used grip that can be attached to and readily removed from a rifle, revolver or other firearm. Once positioned and assembled to the firearm, the grip assembly of the embodiments of the invention provides a means by which the user can use the other hand to grasp the firearm and hold it steadily in position for more accurate aiming and shooting. The grip assembly of the invention is comfortable for the user, inexpensive to manufacture, and provides a substantial advantage in steadying the weapon for aiming and shooting.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is:

1. A user's grip for easy attachment to a long firearm having a trigger guard, a barrel combined with a stock and a mounting base combined with the stock ahead of its trigger guard, the mounting base having an opening, the grip being adapted to assist the user in holding the firearm with the user's hand so as to hold the firearm steady during aiming and shooting, said grip comprising:

a core having an elongated body formed of a solid, rigid material, the core having an upper portion and a lower portion;

the core being of a sufficient length to provide for grasping of the grip by the user's hand;

a pin combined with the core and adapted to engage the opening in the mounting base to provide for swingable movement of the grip relative to the firearm;

a quick detach mechanism that includes the pin combined with the upper portion of the core to provide for removable attachment of the grip to the mounting base of the firearm; and a grip assembly substantially surrounding the core and adapted to being gripped by the user, the grip assembly being of a relatively soft material and having a plurality of finger recesses formed in it to provide a comfortable grip for the user's hand.

2. The grip of claim 1 in which a mounting having an opening in it is combined with the lower portion of the core, the mounting extending beneath the grip assembly to provide for attachment of a sling.

3. The grip of claim 2 in which the core is molded in two parts and the quick detach mechanism and pin are held between and by the two parts of the core.

4. The grip of claim 3 in which the grip assembly is molded over the core.

5. A user's grip for easy attachment to a long firearm having a trigger guard, a barrel combined with a stock and a mounting base combined with the stock ahead of its trigger guard, the mounting base having an opening, the grip being adapted to assist the user in holding the firearm with the user's hand so as to hold the firearm steady during aiming and shooting, said grip comprising:

a core having an elongated body formed of a solid, rigid material, the core having an upper portion and a lower portion;

the core being of a sufficient length to provide for grasping of the grip by the user's hand;

a pin combined with the core and adapted to engage the opening in the mounting base to provide for swingable movement of the grip relative to the firearm;

a quick detach mechanism that includes the pin combined with the upper portion of the core to provide for removable attachment of the grip to the mounting base of the firearm; and a grip assembly substantially surrounding the core and adapted to being gripped by the user, the grip assembly having a plurality of finger recesses formed in it to provide a comfortable grip for the user's hand.

6. The grip of claim 5 in which a mounting having an opening in it is combined with the lower portion of the core, the mounting extending beneath the grip assembly to provide for attachment of a sling.

7. The grip of claim 6 in which the core is molded in two parts and the quick detach mechanism and pin are held between and by the two parts of the core.

8. The grip of claim 7 in which the grip assembly is molded over the core.

* * * * *